US005079881A

United States Patent [19]

Haage et al.

[11] Patent Number: 5,079,881

[45] Date of Patent: Jan. 14, 1992

[54] INJECTION PACKER FOR INJECTING SYNTHETIC RESIN INTO CRACKS IN CONCRETE

[75] Inventors: Manfred Haage, Dornstetten-Aach; Willi Haug, Freudenstadt; Dieter Biskop, Stühlingen, all of Fed. Rep. of Germany

[73] Assignee: Fischerwerke Artur Fischer GmbH & Co. KG, Tumlingen, Fed. Rep. of Germany

[21] Appl. No.: 579,938

[22] Filed: Sep. 7, 1990

[30] Foreign Application Priority Data

Sep. 7, 1989 [DE] Fed. Rep. of Germany ..... 3929776
Oct. 28, 1989 [DE] Fed. Rep. of Germany ..... 3936040

[51] Int. Cl.[5] ..... E02D 5/18

[52] U.S. Cl. ..... 52/173 R; 52/514; 405/269

[58] Field of Search ..... 52/173, 744, 774, 514; 405/269

[56] References Cited

U.S. PATENT DOCUMENTS

| | | | |
|---|---|---|---|
| 4,211,049 | 7/1980 | Fischer | 52/744 |
| 4,286,900 | 9/1981 | Sugimoto et al. | 405/269 |
| 4,449,856 | 5/1984 | Tokoro et al. | 405/269 |
| 4,512,123 | 4/1985 | Fischer | 52/173 R |

FOREIGN PATENT DOCUMENTS

| | | | |
|---|---|---|---|
| 528512 | 4/1955 | Belgium | 405/269 |
| 3426088 | 1/1986 | Fed. Rep. of Germany | 52/514 |
| 2192422 | 1/1988 | United Kingdom | 52/744 |

*Primary Examiner*—David A. Scherbel
*Assistant Examiner*—Kien Nguyen
*Attorney, Agent, or Firm*—Michael J. Striker

[57] ABSTRACT

An injection packer for injecting a synthetic resin into cracks in concrete has an elongate plastic body having a longitudinal injection channel, an injection nipple arranged at the rear end of the plastic body and communicating with the injection channel, and a sealing cuff made of a plastic material which is softer than a material the plastic body is made of, and fitted in a positive interengagement manner around the front end of the plastic body.

11 Claims, 2 Drawing Sheets

INJECTION PACKER FOR INJECTING SYNTHETIC RESIN INTO CRACKS IN CONCRETE

BACKGROUND OF THE INVENTION

The invention relates to an injection packer for injecting synthetic resin into cracks in concrete and comprising an elongate plastic body having a through longitudinal injection channel, and an injection nipple inserted into the plastic body at the rear end of the injection channel.

DE-OS 32 03 871 discloses an injection packer comprising a plastic sleeve having a surface that tapers toward the front end face, and an injection nipple attached at the rear end face. The tapering surface allows the known injection packer to be wedged into a drilled hole with generation of considerable expansion forces. If the known injection packer is hammered into a very inclined drilled hole, the large expansion forces can lead to breaking off of pieces from the concrete masonry Injection packers are frequently hammered into bores that have been made at an angle of 45 degrees in a concrete component to be restored. The bore is drilled sufficiently deep into the concrete to insure that the cracks which are to be fully injected with synthetic resin, are intersected by the bore. The epoxy resin can be forced under a pressure of from 100 bar to 150 bar through the injection packer and through the continuation of the bore into the reparable crack.

SUMMARY OF THE INVENTION

The object of invention is an injection packer which can be inserted without difficulty into inclined drilled holes or bores and has high pull-out resistance values to provide for injection of synthetic resin under high pressure The object of the invention is achieved by providing an injection packer with a sealing cuff made of softer plastic material than the plastic body of the injection packer, and which positively engage the front end region of the plastic body. As a result of the use of a sealing cuff at the front end of the injection packer, the expansion pressure emanating from the sealing cuff when the injection packer has been hammered relatively deep into the drilled hole, and the danger of pieces of concrete breaking off is substantially reduced in comparison with conventional injection packers which are wedged mainly in the region of the openings of drilled holes in masonry. Because the sealing cuff is made of a relatively soft material, optimum sealing and uniform distribution of the expansion forces are achieved. The plastic body on which the sealing cuff is arranged is made of a substantially harder material, preferably glass-fibre-reinforced polyamide. This hard material has the advantage that the injection packer can be hammered without difficulty into the drilled hole and after the injection process the portion of the injection packer projecting from the mouth of the drilled hole, can be struck off with a hammer or the like.

The sealing cuff is preferably so constructed that it projects significantly beyond the plastic body at its front end. As a result, a resilient region is formed at the front end of the injection packer which facilitates hammering-in of the injection packer.

The sealing cuff may have shoulders, one behind other, each of which has an annular surface that is cone-like toward the front end, with the result that the injection packer can be more easily hammered into a drilled hole It is preferable that the sealing cuff as a whole tapers towards the front end, its maximum outside diameter being, of course, greater than the diameter of the respective drilled hole in order for the injection packer to be wedged tightly in the drilled hole.

The sealing cuff is preferably injected-molded by the two-component injection molding process onto the plastic body. The plastic body may have an appropriate profile in the region of the sealing cuff to provide for a positive interconnection between the sealing cuff and the plastic body. Because of high pressing forces that are generated during the injection process, this positive interconnection is very advantageous since it ensures an extremely stable mechanical connection between the plastic body and the sealing cuff.

The sealing cuff made from soft material is fitted around annular shoulders on the plastic body, which widen towards its front end. This has the that an axial displacement of the plastic body in direction of the mouth of the drilled hole in the region annular shoulders produces an expansion pressure which acts substantially radially on the sealing cuff and, presses the latter even more firmly against the wall drilled hole.

The front end of the body may have annular collars with preferably truncate surfaces around which the sealing cuff is fitted positive inter-engagement. Each of the annular collars thus like an expander member which causes the sealing cuff to in the case of axial displacement. As a result of the injection pressure in the region of the drilled hole to restored, an axial force component directed towards the of the drilled hole may act on the plastic body. This ax force component produces in the region of the truncated-cone-shaped or conical surfaces of the annular shoulders of the plastic body a radial force component that helps to jam the sealing cuff tightly in the drilled hole.

Tests have shown that of the annular shoulders provided on the outside of the sealing cuff may have a larger diameter than the shaft of the plastic body and whose diameter matches the diameter of the drilled hole. The resilient annular shoulders of increased diameter ensure a stable mechanical connection between the sealing cuff and the wall of the drilled hole so that the sealing cuff does not lose its sealing function even under high pressures.

The present invention both as to its construction so to its method of operation, together with additional objects and advantages thereof, will be best understood from the following detailed description of specific embodiments when read in connection with the accompanying drawings.

DETAILED DESCRIPTION OF THE PREFERRED EMBODIMENTS

Figure 1:
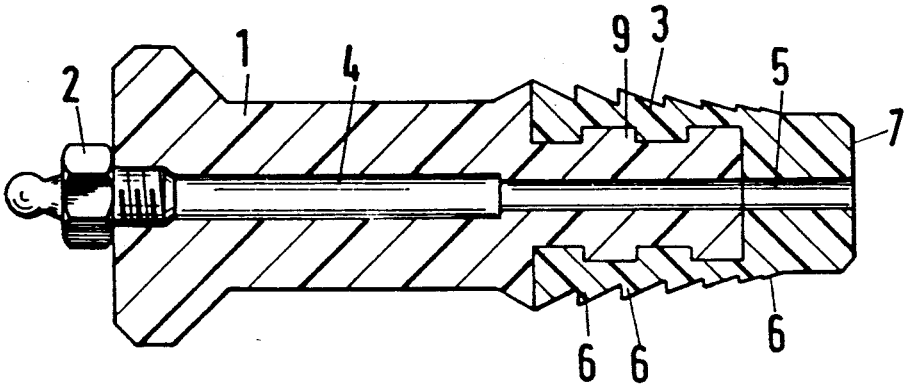
FIG. 1 shows a cross-sectional view of an injection packer with sealing cuff according to the invention.

The injection packer shown in FIG. 1 comprises a plastic body 1 equipped with an injection nipple 2 and a sealing cuff 3 which has been injection-molded onto the front end of the plastic body 1. The plastic body 1 is made of glass-fibre-reinforced polyamide, while the sealing cuff 3 is made from a softer plastic material, for example, polyurethane or polyethylene.

The injection nipple 2 leads to an injection channel 4 which passes axially through the whole injection packer. Part of the injection channel 4 is formed by a through channel in the sealing cuff 3.

The sealing cuff 3 has a plurality of annular shoulders 6, arranged one behind the other and a longitudinal section of which forms a toothing. The annular shoulders 6 are in the form of truncated cones, the diameter of which tapers towards the front end 7. In addition, the sealing cuff 3 as a whole tapers towards the front end 7. As a result, the diameter of the individual annular shoulders 6 also decreases towards the front end 7. Because of this somewhat wedge-like shape of the sealing cuff 3, the scaling cuff 3 is firmly jammed in the drilled hole 8 (FIG. 2) and anchors the injection packer in such a manner that it is sealed. It is important, that the sealing cuff 3 and the plastic body 1 are firmly connected to one another. To this end, a profile 9 is provided on the plastic body 1 in the region where it is engaged with the sealing cuff 3. The profile 9 produces a positive interconnection with the scaling cuff 3. The scaling cuff 3 is injection-molded by the two-component injection molding process onto the plastic body 1, producing an optimum connection with the plastic body 1.

Figure 2:
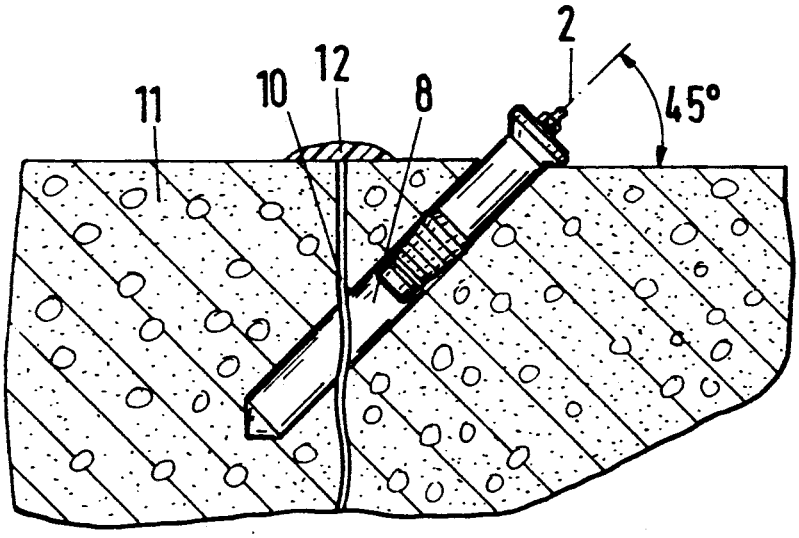
FIG. 2 shows an elevational view of the injection packer according to FIG. 1 inserted into an inclined drilled hole.

FIG. 2 shows the injection packer when it has been hammered into a drilled hole 8. The drilled hole 8 intersects a crack 10 which is to be completely injected with synthetic resin and which is formed in the wall surface of the concrete masonry 11 with sealing means 12. Using a high-pressure injector that is known per se, epoxy resin can be injected by the injection packer through the injection nipple 2, into the drilled hole 8 and further into the crack 10. The injection pressure may be in the region of from 100 bar to 150 bar or even higher.

Figure 3:
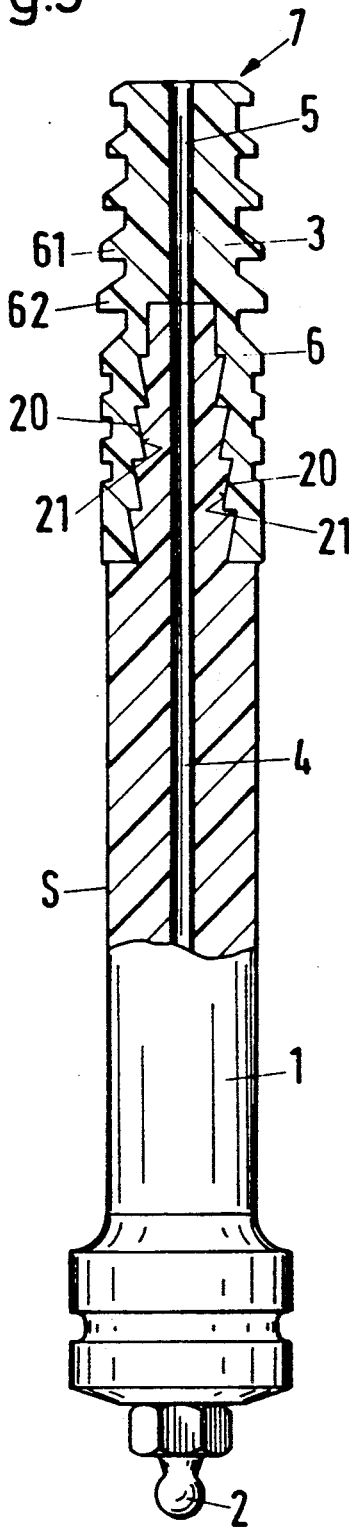
FIG. 3 shows a cross-sectional view of another embodiment of the injection packer according to the invention.

In the embodiment shown in FIG. 3, the plastic body 1 has in the region that penetrates into the sealing cuff 3 a plurality of annular shoulders 20 arranged one behind the other against which correspondingly conical inside surfaces 21 of the sealing cuff 3 rest. In order to obtain a positive interconnection between sealing cuff 3 and plastic body 1, the sealing cuff 3 is injection-molded onto the plastic body 1 by the two-component injection molding process. In this embodiment, two annular shoulders 61, 62 on the sealing cuff 3 have a slightly larger diameter than the straight shaft S of the plastic body 1.

While the invention has been illustrated and described as embodied in an injection packer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected Letters Patent is set forth in the appended claims.

What is claims is:

1. An injection packer for injecting a synthetic resin into cracks in concrete, comprising an elongate plastic body having a longitudinal injection channel and front and rear ends; an injection nipple arranged at the rear end of said plastic body and communicating with said injection channel; and a separate sealing cuff made of a plastic material which is softer than a material the plastic body is made of, and fitted in a position inter-engagement manner around the front end of said plastic body, said longitudinal injection channel extending from said front end to said rear end and through said plastic body and said sealing cuff.

2. An injection packer as set forth in claim 1, wherein said sealing cuff projects substantially beyond the front end of said plastic body and has an injection channel that forms a continuation of said injection channel of said plastic body.

3. An injection packer as set forth in claim 1, wherein said sealing cuff has a plurality of projecting annular shoulders distributed over a length thereof with each shoulder having a truncated cone-shaped surface.

4. An injection packer as set forth in claim 3, wherein said sealing cuff has inner conical surface means engaging truncated cone-shaped surfaces of said plurality of annular shoulders.

5. An injection packer as set forth in claim 1, wherein said sealing cuff tapers towards the front end of said injection packer.

6. An injection packer as set forth in claim 1, wherein the front end of said plastic body has one of notches, annular grooves and the like positively engaged by said sealing cuff.

7. An injection packer as set forth in claim 1, wherein said plastic body is made of a glass fiber-reinforced polyamide, and said sealing cuff is made of one of polyethylene and polyurethane.

8. An injection packer as set forth in claim 1, wherein the front end of said plastic body engaged with said sealing cuff, has a plurality of annular shoulders arranged one behind another and which widen in a diameter towards a front end surface of said plastic body.

9. An injection packer as set forth in claim 8, wherein each of said plurality of annular shoulders has a truncated cone-shaped surface.

10. An injection packer as set forth in claim 1, wherein said plastic body has a shaft, said sealing cuff having at least one annular shoulder projecting radially beyond a portion of said shaft located adjacent to said sealing cuff.

11. An injection packet for injecting a synthetic resin into cracks in concrete, comprising an elongate plastic body having a longitudinal injection channel and front and rear ends; an injection nipple arranged at the rear end of said plastic body and communicating with said injection channel; and a separate sealing cuff made of a plastic material which is softer than a material the plastic body is made of, and fitted in a positive inter-engagement manner around the front end of said plastic body, said sealing cuff projecting substantially beyond the front end of said plastic body and having an injection channel that forms a continuation of said injection channel of said plastic body, said sealing cuff having a plurality of projection annular shoulders distributed over a length thereof with each shoulder having a truncated cone-shaped surface, the front end of said plastic body having one of notches, annular grooves and the like positively engaged by said sealing cuff, said longitudinal injection channel extending from said front end to said rear end and through said plastic body and said sealing cuff.

* * * * *